United States Patent [19]

Lyczek

[11] Patent Number: 4,791,413

[45] Date of Patent: Dec. 13, 1988

[54] SOIL MOISTURE DETECTOR WITH LIGHT ACTIVATED AUDIO ALARM INHIBITOR

[76] Inventor: Kazimierz E. Lyczek, 428 Quail Ridge Cir., Spartanburg, S.C. 29303

[21] Appl. No.: 78,126

[22] Filed: Jul. 15, 1987

[51] Int. Cl.[4] ..... G08B 21/00

[52] U.S. Cl. ..... 340/604; 324/65 R; 307/117; 361/175

[58] Field of Search ..... 340/602, 604, 870.29; 250/200, 564, 213 A; 361/173, 175; 200/61.02; 307/117; 73/291, 293, 304 R; 324/65 R

[56] References Cited

U.S. PATENT DOCUMENTS

| | | | |
|---|---|---|---|
| 3,590,335 | 6/1971 | Tetar | 361/175 |
| 3,927,370 | 12/1975 | De Bough | 340/604 |
| 4,514,722 | 4/1985 | Batcheler et al. | 340/604 |

*Primary Examiner*—Joseph A. Orsino, Jr.
*Assistant Examiner*—Jill D. Jackson

[57] ABSTRACT

The soil moisture alarm device comprising of a conductivity sensor, a photoelectric light sensor, an ON-OFF controllable audio generator, a buzzer and a DC battery as a source of power. The device can be placed in the pot permanently. It will not work without ambient light, so that it will not disturb people at night when they are sleeping.

2 Claims, 1 Drawing Sheet

SOIL MOISTURE DETECTOR WITH LIGHT ACTIVATED AUDIO ALARM INHIBITOR

BACKGROUND OF THE INVENTION

The present invention relates to soil moisture gauges. A known such device is a pot soil moisture gauge which comprises a two electrode probe, electronic measuring circuit, DC milliammeter as an indicator and solar cell battery as a source of power. The indicator has a scale where full range is divided on ten parts and described with digits 0 to 10.

The gauge is provided with a manual instruction booklet which tells how to use the gauge and what readings are proper for certain plants.

The pot soil moisture gauge is to be used for checking the moisture of soil in pots of household plants in order to keep the soil moist enough for plant growth. To do this, one has to insert the probe into the soil, read what the indicator shows and compare this reading with the data in the booklet. Depending on the reading, at times it will be necessary to water the soil.

The above described gauge works well, but there is one fault: the user has to remember to check the soil moisture of his/her plants. The problem is that people, even those who love plants, sometimes are too busy to think of their plants. They forget to check the moisture of the soil and when the soil gets too dry their plants may die. To eliminate this problem there has been developed continuously monitoring soil moisture devices such as devices disclosed in U.S. Pat. Nos. 4,268,824 and 4,512,722. These devices are designed for continuous operation, thus they work unnecessarily during the night when people usually are sleeping, causing premature discharge of the battery resulting in failure of the device.

SUMMARY OF THE INVENTION

It is, therefore, an object of the present invention to provide a highly reliable device which will remind people to water their plants. Briefly stated, according to the present invention the soil moisture detector comprises: a conductivity sensor to be inserted into the soil, a photoelectric light sensor, an ON-OFF controllable audio generator, a buzzer and a DC battery as a source of power. The detector can be placed in the pot and left in permanently. It will not work without ambient light, so that it will not disturb people at night when they are sleeping.

DESCRIPTION OF THE PREFERED EMBODIMENT

Figure 1:
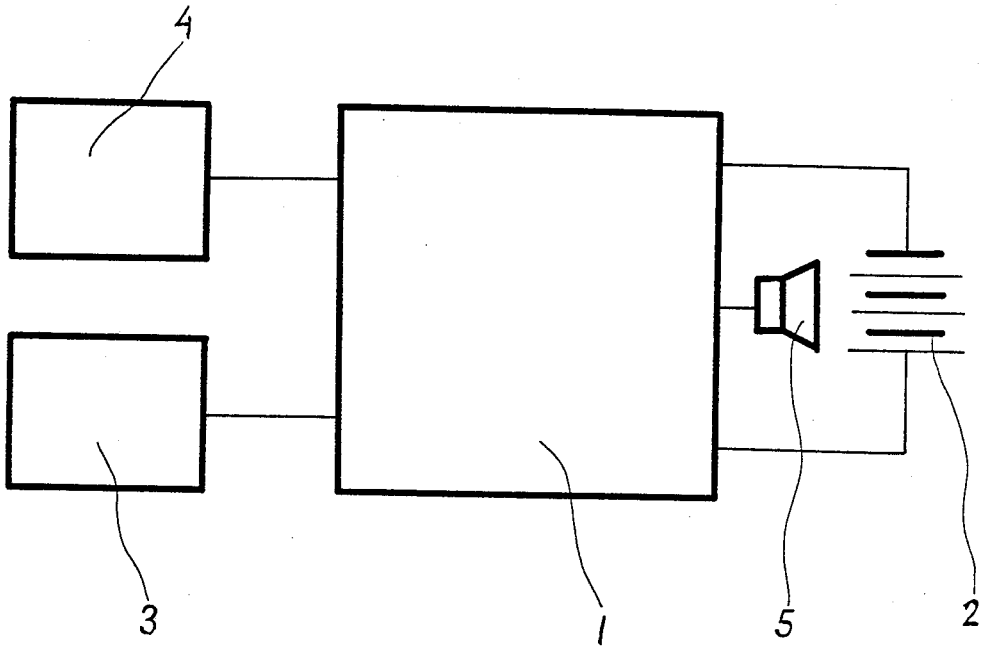
FIG. 1 shows block diagram of the soil moisture detector with light activated audio alarm inhibiter.

The soil moisture detector of FIG. 1 comprises an ON-OFF audio generator 1, a source of DC electric current 2, a conductivity sensor 3, a photoelectric light sensor 4, and a buzzer 5.

The ON-OFF controllable audio generator 1 is a square wave, two-input-gated generator fed by source of DC electric current 2. Its first input is connected to the conductivity sensor 3, the other input is connected to the photoelectric light sensor 4. The output of the ON-OFF controllable audio generator 1 is connected to the buzzer 5. The conductivity sensor 3 has two electrodes to be inserted into the soil. When the soil is wet, its conductivity is high, thus first input of generator 1 has logical signal 0. The other input of generator 1, which is conected to the photoelectric light sensor 4, has logical signal equal to 1 in daylight and logical signal 0 in the dark. At these conditions the controllable audio generator 1 does not work.

When the soil dries, is conductivity decreases. At certain conductivity level first input of controllable audio generator 1 gets logical signal 1. When its other input also has logical signal 1 (this can happen only in the presence of light) the controllable audio generator 1 starts to work and buzzer 5 sounds, thus reminding people to water the plant.

By watering the soil, its conductivity increases and the controllable audio generator 1 shuts off.

The soil moisture detector may comprise a solar cell battery as a power source. In this case, there is no need for a separate photoelectric light sensor because the solar cell battery combines the action of the power source and the light sensor.

What is claimed is:

1. A soil moisture detector with light activated audio alarm inhibiter for use in household plant care by means of generating audio sound when moisture level is too low comprising: a source of DC electric current means, a conductivity sensor means to be inserted permanently into the soil, a photoelectric light sensor means, an ON-OFF controllable audio generator means having one input connected the conductivity sensor and the other input connected to the photoelectric light sensor, wherein said ON-OFF controllable audio generator means includes means for generating audio frequency when both light sensor senses daylight (or any light whose intensity is equal to daylight) and conductivity sensor senses low conductivity of the soil.

2. Device according to claim 1 employing the solar cell battery as a cource of DC electric current wherein said solar cell battery also acts as the photoelectric light sensor.

* * * * *